US006577060B2

(12) United States Patent
Tokai et al.

(10) Patent No.: US 6,577,060 B2
(45) Date of Patent: Jun. 10, 2003

(54) DISPLAY DEVICE

(75) Inventors: Akira Tokai, Kawasaki (JP); Manabu Ishimoto, Kawasaki (JP); Tutae Shinoda, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 118 days.

(21) Appl. No.: 09/729,322

(22) Filed: Dec. 5, 2000

(65) Prior Publication Data

US 2001/0028216 A1 Oct. 11, 2001

(30) Foreign Application Priority Data

Mar. 17, 2000 (JP) ..... 2000-075381

(51) Int. Cl.[7] ..... H01J 61/00
(52) U.S. Cl. ..... 313/581; 313/243; 313/306
(58) Field of Search ..... 313/581, 582, 313/584, 590, 621, 238, 243, 292, 306

(56) References Cited

U.S. PATENT DOCUMENTS 6,340,824 B1 * 1/2002 Komoto et al. ..... 257/100

FOREIGN PATENT DOCUMENTS

| | | |
|---|---|---|
| JP | 61-103187 | 5/1986 |
| JP | 11-3649 | 1/1999 |
| JP | 11-162358 | 6/1999 |

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A display device has a screen made of a substrate and a group of elongated illuminators that are arranged on the substrate. Elongated electrode supporters are arranged on at least one side of the illuminators in the width direction. The elongated electrode supporter has plural electrodes that am spaced along the longitudinal direction of the illuminator and define corresponding discharge cells. A wiring conductive pattern is formed on the substrate for supplying electricity to the plural electrodes of the electrode supporter. Selective light emission from the discharge cells of the illuminator is controlled by signals applied to the wiring conductive pattern and the plural electrodes.

45 Claims, 12 Drawing Sheets

DISPLAY DEVICE

BACKGROUND OF THE INVENTION

1. Field of the Invention

The present invention relates to a display device comprising plural elongated illuminators.

There is a limit to enlarging a screen of a display having a single structure. A very large display of self-luminous type that is used in a stadium or an event place is made of plural light sources such as cathode-ray tubes or light emitting diodes (LEDs) arranged in a matrix. Normally, the total number of the light sources is several hundreds of thousands or more, and a lot of labors and costs are required for assembling the display. Therefore, it is asked to realize a bright screen having a dimension of several meters easily.

2. Description of the Prior Art

A very large display utilizing a light emission principle of a plasma display panel (PDP) has been suggested by the present applicant as a "large gas discharge display panel," which is disclosed in Japanese unexamined patent publication No. 61-103187.

The suggested display has a combination structure of plural elongated illuminators arranged in one direction. Each of the illuminators corresponds to a PDP having a single row or column. This display has following advantages over other kinds of displays.

(1) The illuminators are arranged in one direction, so the number of man-hours for assembling them can be smaller than the case where they are arranged in two directions (row and column directions).

(2) The cells of a row are formed as a unit, so a lighter and less expensive display can be realized than the case where an independent light source is arranged for each cell.

(3) The illuminator has a higher luminance than a light emitting diode.

In addition, though the dimension (the numbers of rows and columns) of a PDP having a structure is determined by the size of a glass substrate, the suggested display having the combination structure can realize any rows (or columns) of display by increasing or decreasing the number of arranged illuminators. Though the number of rows (or columns) depends on a length of a light emission module, it is much easier elongating the illuminator than enlarging a PDP. It is not realistic to manufacture a glass substrate having a very large area from the viewpoint of a plant and a conveyance. Namely, when trying to manufacture a large display by a single structure, a glass plate that is larger than a screen size should be handled, and a size larger than 100 inches is not realistic. The upper limit of the dimension of a display (such as a pixel size or a screen size) that can be produced depends on manufacturing facilities. In order to produce a large display having a larger dimension than the manufacturing facilities, new manufacturing facilities have to be constructed. In contrast, if the production is performed by a unit of line (row), an engineering change for easy assembling and for responding to the dimension of the display can be performed without a large change of the manufacturing facilities. Therefore, various sizes of displays can be realized at a low cost.

Other conventional examples of such arrangement of elongated illuminators are explained in Japanese unexamined patent publications No. 11-3649 and No. 11-162358. The former discloses a display device having a structure in which fibers with embedded electrodes are arranged on the front side of the illuminators arranged in the horizontal direction. The latter discloses a display device in which illuminating tubes are arranged on a substrate with column electrodes and row electrodes are formed on the front side of the illuminating tubes.

In the conventional above-mentioned display device disclosed in Japanese unexamined patent publication No. 61-103187, electrodes of many illuminators should be connected so as to form an electrode matrix after arranging the illuminators, and the wire connection is a burdensome job. In the conventional display device disclosed in Japanese unexamined patent publications No. 11-3649 or No. 11-1623358, the electrodes extending in one direction of the electrode matrix are arranged in the front side of the illuminator, so a consideration of decreasing a light shield by using a transparent material is required. In addition, when forming a row electrode over the illuminators after arranging them, it is difficult to secure an accuracy of the position of a paste print for a large screen if a thick-film process is used. In contrast, if a thin-film process is used, a unit of production becomes not a line but a surface, so the above-mentioned advantage of the production facilities fades out.

SUMMARY OF THE INVENTION

The object of the present invention is to provide a display device made of a group of elongated illuminators, which enable an electrode matrix to be formed easily.

FIGS. 1A–1C are diagrams showing a basic concept of the present invention.

The display device 10 of the present invention has illuminators 40 arranged on a substrate 20, and electrode supporters 50 are arranged along each of the illuminators 40. In order to let plural portions (cells) of the illuminator 40 in the longitudinal direction emit light selectively in any desired combination, the electrode supporter 50 is provided with electrodes X, Y. The substrate 20 is provided with wiring conductive patterns 30*x*, 30*y* for supplying electricity to the electrodes X, Y. The electrodes X, Y and the wiring conductive patterns 30*x*, 30*y* are connected electrically by assembling the substrate 20 and the electrode supporter 50, so that an electrode matrix is formed that enables any image display.

DESCRIPTION OF THE PREFERRED EMBODIMENTS

Hereinafter, the present invention will be explained more in detail with reference to embodiments and drawings.

Figure 1A:
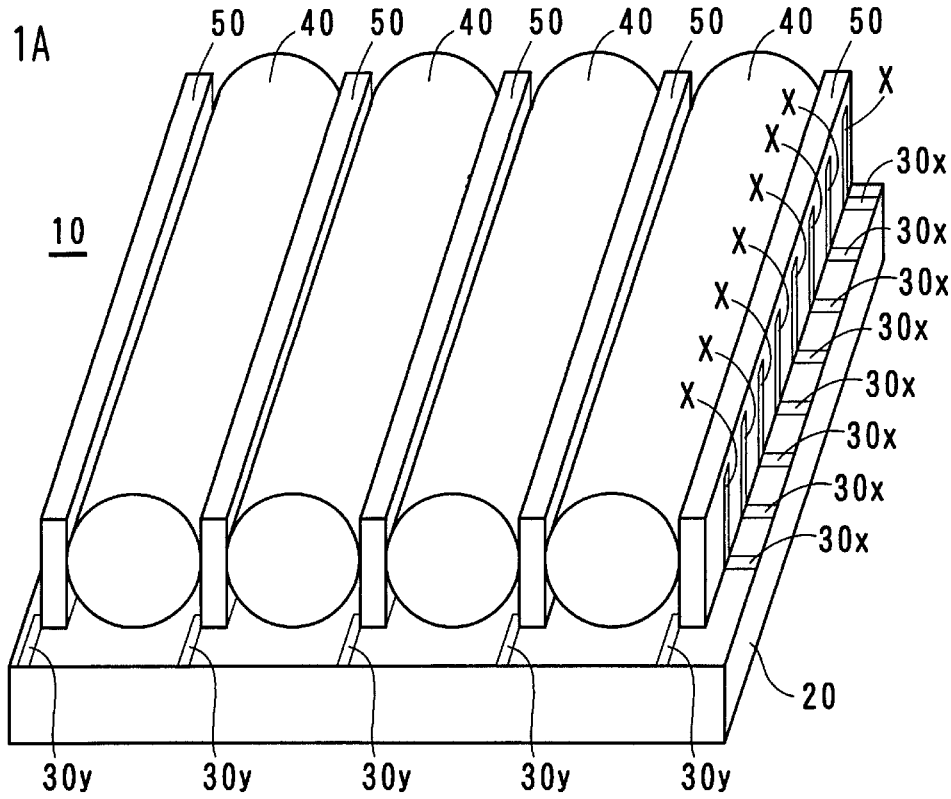
FIGS. 1A–1C are diagrams showing a basic concept of the present invention.
Figure 1B:
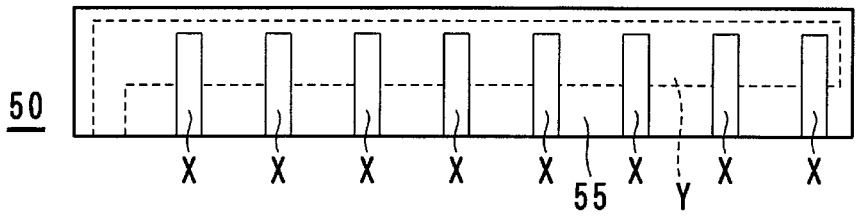
Figure 1C:
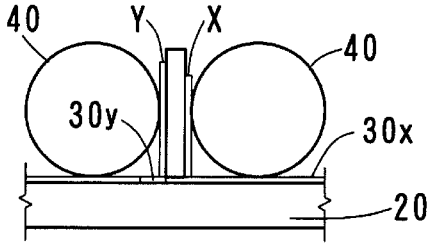

FIGS. 1A–1C are diagrams showing a basic concept of the present invention.

The display device 10 of the present invention has illuminators 40 arranged on a substrate 20, and electrode supporters 50 are arranged along each of the illuminators 40. In order to let plural portions (cells) of the illuminator 40 in the longitudinal direction emit light selectively in any desired combination, the electrode supporter 50 is provided with electrodes X, Y. The substrate 20 is provided with wiring conductive patterns 30*x*, 30*y* for supplying electricity to the electrodes X, Y. The electrodes X, Y and the wiring conductive patterns 30*x*, 30*y* are connected electrically by assembling the substrate 20 and the electrode supporter 50, so that an electrode matrix is formed that enables any image display.

A preferred embodiment of the electrode supporter 50 is a double-sided wiring board. Anodes are arranged on one side of an elongated plate support member 55, and cathodes are arranged on the other side. However, these anode and cathode do not make an electrode pair that is used for controlling one illuminator 40 and are related to two illuminators 40 that are adjacent to each other. Namely, two electrode supporters 50 facing to each other with respect to the illuminator 40 are necessary for controlling the illuminator 40. It is possible to arrange either the anode or the cathode on one electrode supporter 50, but in this case two kinds of electrode supporters 50 have to be prepared for forming the electrode matrix. If a single-sided wiring board is used, the number of electrode supporters 50 becomes twice the number in the case of the double-sided wiring board. In FIG. 1B, the electrodes X for a predetermined number of cells are arranged on one side of the support member 55, and the electrode Y extending in the longitudinal direction are formed on the other side. One of the electrodes X, Y is used as the anode, and the other is used as the cathode. Each of the electrodes X extends from the position abutting the illuminator 40 to the lower end of the support member 55, so as to connect with the aligned, respective wiring conductive pattern 30*x* (see FIG. 1C). The electrode Y has a lead-out portion at an end in the longitudinal direction for connecting with the aligned, respective wiring conductive pattern 30*y*.

If the material of the support member 55 is an elastomer (e.g., a polyurethane resin), the electrodes X, Y and the illuminator 40 can be contacted more tightly, so that the light emission control can be performed in more stable manner. In addition, the illuminator 40 can be held more securely. The effect of the tight contact between the electrodes X, Y and the illuminator 40 can be obtained if at least the part of the support member 55 around the contact portion with the illuminator 40 is elastic.

In the illustrated example, the length of the electrode supporter 50 corresponds to one illuminator 40. In another example in which two or more illuminators 40 are joined so as to form a light emission line, the electrode supporter 50 can have a length that corresponds to the light emission line. On the contrary, two or more electrode supporters 50 can join along one illuminator 40. Concerning the substrate 20 too, plural sub-substrates can be joined so as to make one substrate 20.

Figure 2:
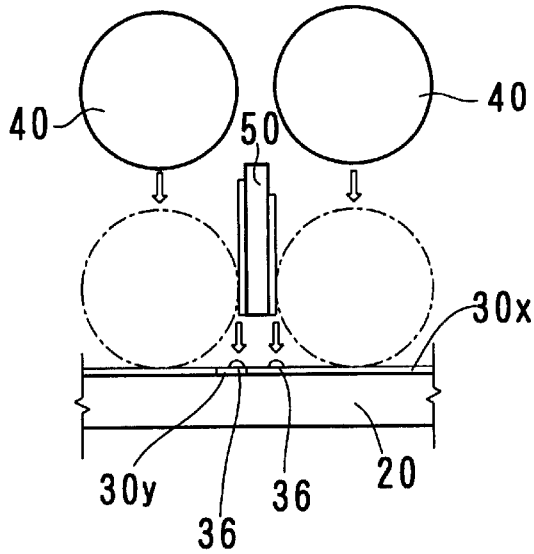
FIG. 2 is a diagram showing a basic form of assembling a display device according to the present invention.

FIG. 2 is a diagram showing a basic form of assembling a display device according to the present invention.

Bumps 36 are formed on predetermined positions on the wiring conductive patterns 30*x*, 30*y*. The bumps 36 and the electrodes X, Y are aligned so that the electrode supporter 50 is fixed to the substrate 20. In another method using a conventional mounting technology, the substrate 20 is provided with a groove, in which the electrode supporter 50 is inserted and fixed.

Figure 3A:
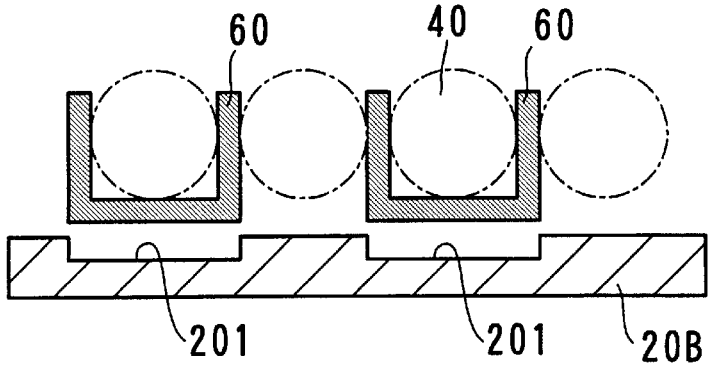
FIGS. 3A and 3B are diagrams showing another example of the electrode supporter.
Figure 3B:
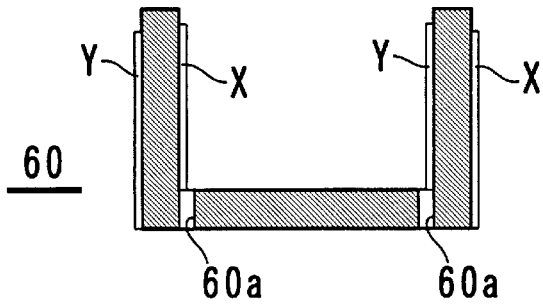

FIGS. 3A and 3B are diagrams showing another example of the electrode supporter.

The electrode supporter 60 in this example has an elongated body with a substantially U-shaped cross section in which a bottom portion 60–1 and a pair of side portions 60–2 are integrated. Each side portion 60–2 corresponds to the above-mentioned electrode supporter 50, and a gap between the side portions 60–2 is substantially the width of the illuminator 40. The electrode supporters 60 are attached to the substrate 20B at the ratio of two electrode supporters 60 per three light emission lines. In the assembled state, the neighboring electrode supporters 60 sandwich the illuminator 40 for one light emission line. In order to equalize heights of the illuminator 40 between the pair of electrode supporters 60 and the illuminator 40" inside each electrode supporter 60, the substrate 20B is provided with a groove 201 in which the bottom portion of a respective electrode supporter 60 fits. Actually, a wiring conductive pattern crosses the groove 201 though it is not illustrated. This groove 201 is useful also for the registration of the electrode supporter 60 and the illuminator 40.

The bottom portion of the electrode supporter 60 has a through hole 60*a* for leading out the electrodes X, Y that are provided at the inner surface of the side portion to the lower surface. A plating technology can be used for forming a conductor in the through hole 60*a*.

Figure 4A:
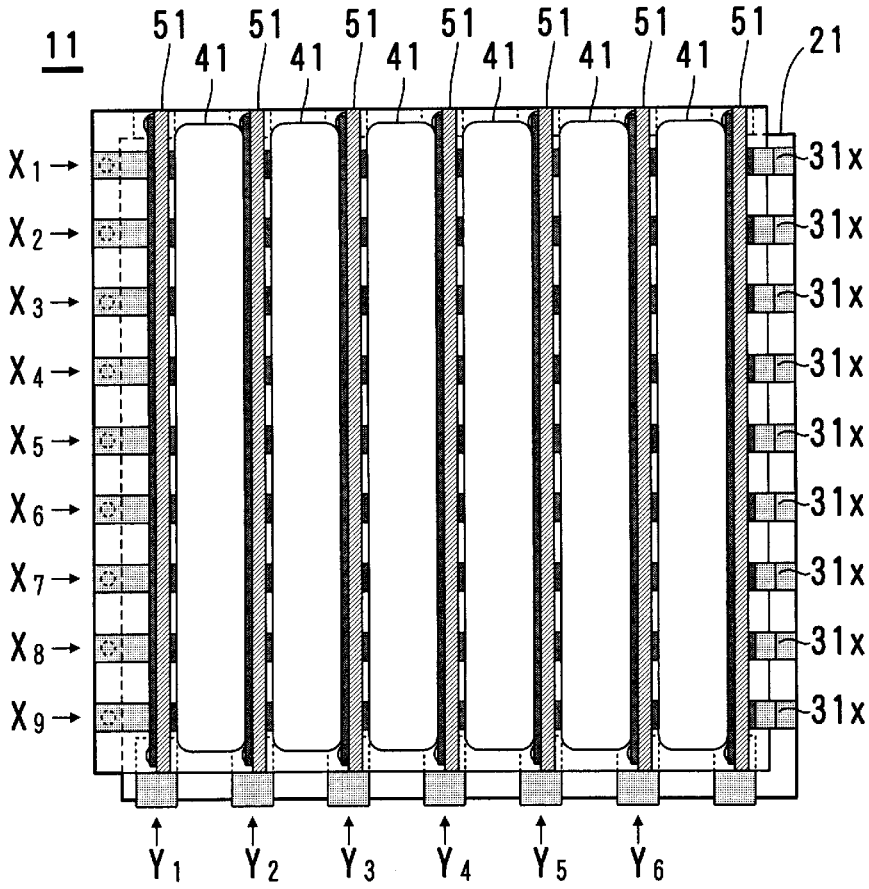
FIGS. 4A and 4B are schematic structural diagrams of a display device according to a first embodiment of the present invention.
Figure 4B:
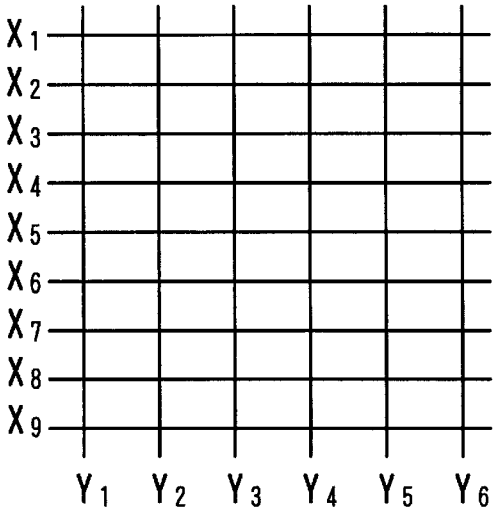

FIGS. 4A and 4B are schematic structural diagrams of a display device according to a first embodiment of the present invention. FIG. 4A shows an appearance viewed from the top. FIG. 4B shows an electrode matrix.

The display device 11 has a screen including a substrate 21 and a group of elongated illuminators 41 arranged on the substrate 21. Electrode supporters 51 having elongated plate-like shapes are arranged on respective, opposite sides of each illuminator 41 in the width direction. On one side of the electrode supporter 51, electrodes X (the suffix indicates the order of the arrangement in the figure) having a strap shape are arranged along the longitudinal direction of the illuminator 41. On the other side, an electrode Y is arranged, extending along the longitudinal direction of the illuminator 41. The electrodes X is connected electrically with respective, aligned wiring conductive patterns 31*x* formed on the substrate 21, so that an electrode matrix, as shown in FIG. 4, is formed.

Figure 5A:
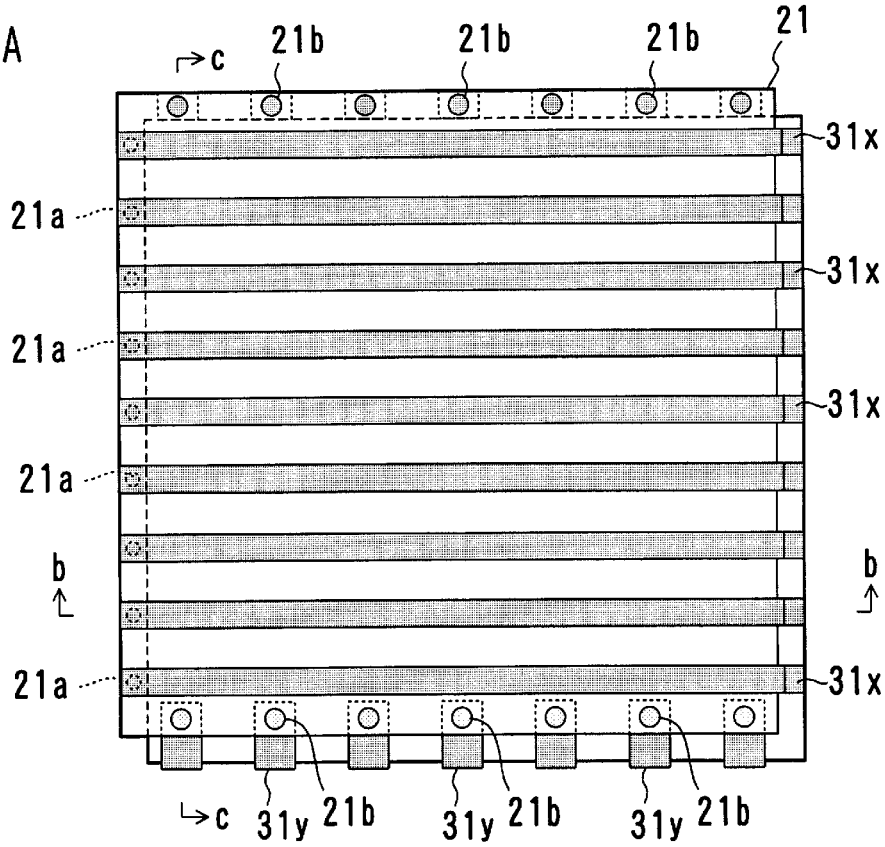
FIGS. 5A–5C are diagrams showing a substrate structure of the display device according to the first embodiment.
Figure 5B:
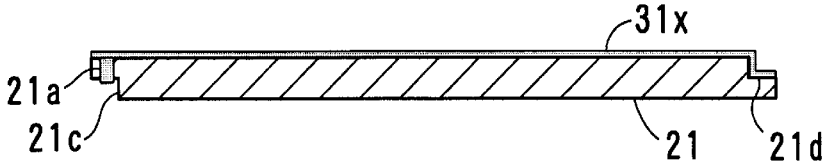
Figure 5C:
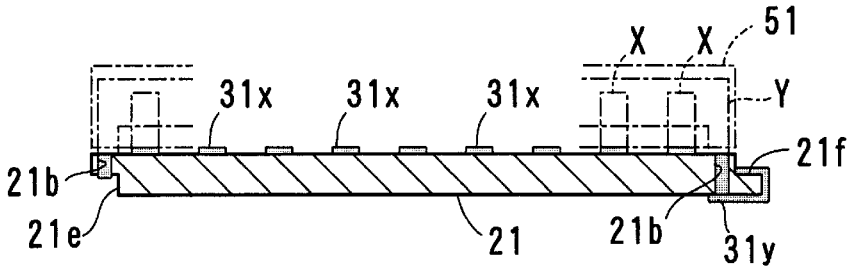

FIGS. 5A–5C are diagrams showing a substrate structure of the display device according to the first embodiment. FIG. 5A is a plan view. FIG. 5B is a cross section cut along the line 5B–5B of FIG. 5A. FIG. 5C is a cross section cut along the line 5C–5C of FIG. 5A.

The wiring conductive patterns 31*x* are formed on the front side of the substrate 21, and wiring conductive patterns 31*y* are formed on the rear side. The wiring conductive patterns 31*y* become terminal for connecting the electrodes Y to a drive circuit. As shown in FIG. 5B, on opposite sides of the longitudinal direction of each illuminator on the substrate 21, step portions 21*c*, 21*d* are formed for linking the plural substrates 21. On the step portion 21*c* whose backside is a recess, a through hole 21*a* is formed for leading out the wiring conductive pattern 31*x* on the front side to the rear side. In addition, a through hole 21*b* is formed at the position corresponding to the wiring conductive pattern 31*y*. As shown in FIG. 5C, the electrode Y and the wiring conductive pattern 31*y* are connected via through hole 21*b*. In addition, step portions 21*e* and 21*f* are formed on the opposite sides of the substrate 21, spaced apart by the longitudinal direction of the illuminator, of for linking plural substrates 21.

Figure 6A:
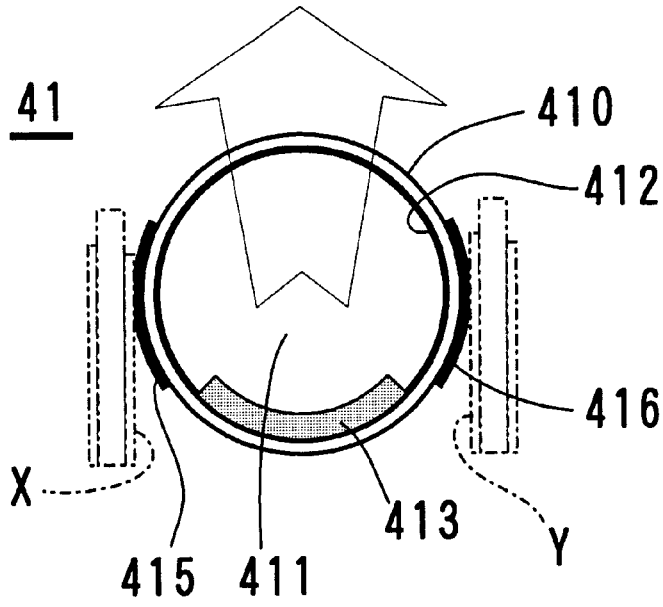
FIGS. 6A and 6B are diagrams showing an example of the illuminator.
Figure 6B:
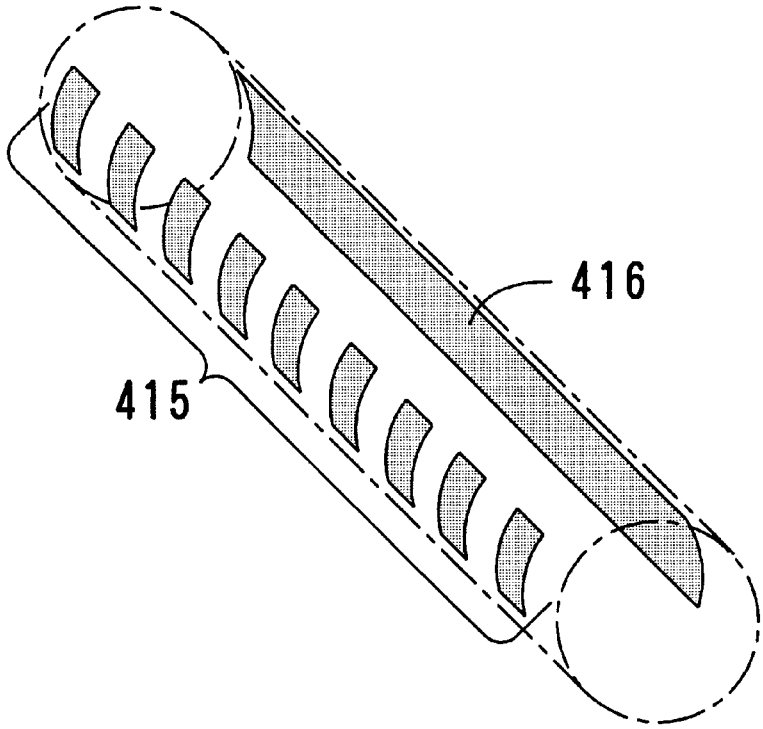

FIGS. 6A and 6B are diagrams showing an example of the illuminator. FIG. 6A shows a structure in a cross section along the width direction. FIG. 6B shows a location of an auxiliary conductor.

The illustrated illuminator 41 emits light by a gas discharge in the same manner as a PDP. The inner surface of the glass tube 410 sealing a discharge gas space 411 is covered with a protection film 412 made of magnesia, and a fluorescent material layer 413 is formed at the rear side in the tube. In order to form the protection film 412, a liquid magnesium organic salt is coated and pyrolysis of the magnesium organic salt is generated. According to this method, a uniform film can be formed on the inner surface of the glass tube having the diameter of 1 mm and the thickness of 100 $\mu$m. On the outer surface of the glass tube 410, auxiliary conductors 415, 416 are fixed for enlarging the effective electrode area and for defining the cell position. The auxiliary conductors 415 are formed in a land pattern, and the number thereof is the same as the number of the electrodes X. The auxiliary conductors 415 are arranged so that each of them abuts a respective one of the electrodes X. The auxiliary conductor 416 is formed in a stripe pattern and abuts a respective electrode Y over the entire length. There are some methods of forming the auxiliary conductors 415, 416. One method is printing a conductive paste in a predetermined pattern. In another method, a conductive film is formed on the entire surface of the outside and is patterned by a photolithography. In still another method, a photosensitive conductive paste is coated on the area including the forming area and is patterned by a photolithography.

In the display device 11 that utilizes such illuminators 41, a drive method for a so-called simple matrix structure PDP can be used for displaying an image. Three kinds of illuminators 41 having light emission colors of red, green and blue are arranged in a predetermined order, so that a color display can be realized.

Figure 7:
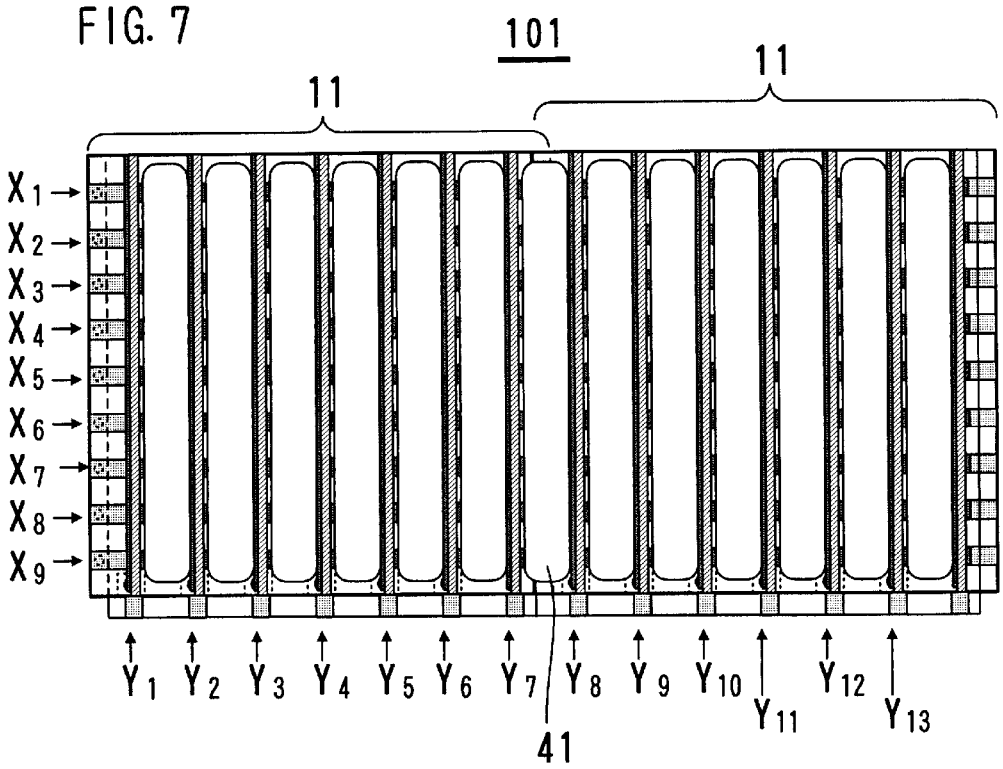
FIG. 7 is a plan view of an integrated display device using the display devices according to the first embodiment.

FIG. 7 is a plan view of an integrated display device using the display devices according to the first embodiment. The integrated display device 101 includes two display devices 11. An illuminator 41 is disposed also at the junction of the display devices 11, so the number of the illuminators 41 is larger than twice the number of illuminators used in a single display device 11.

Figure 8A:
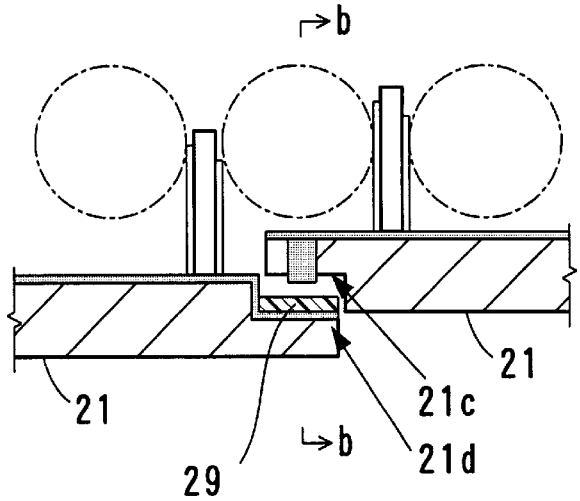
FIGS. 8A and 8B show a linking structure of the display devices according to the first embodiment.
Figure 8B:
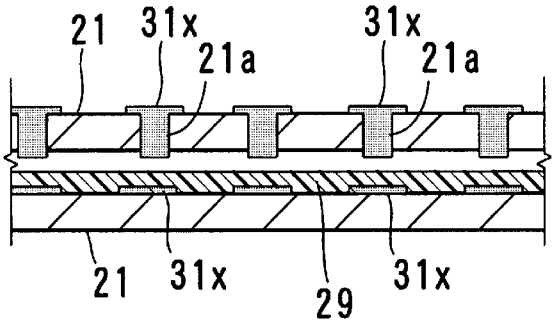

FIGS. 8A and 8B show a linking structure of the display devices according to the first embodiment. FIG. 8A is a cross section of FIG. 7 along line 8B–8B, and FIG. 8B is a cross section of FIG. 8A cut along line 8B–8B in FIG. 8A.

When assembling the integrated display device 101, the step portion 21*c* of the substrate 21 and the step portion 21*d* of the other substrate 21 are overlaid. An anisotropic conductive adhesive 29 is used for electrically connecting the two substrates 21, and the substrates are combined by thermocompression bonding.

FIGS. 9A–9D are diagrams showing another example of the illuminator. In FIGS. 9A–9D, the elements corresponding to those in FIG. 6 are denoted by the same reference as in FIG. 6, so that the explanations of the elements are omitted.

Figure 9A:
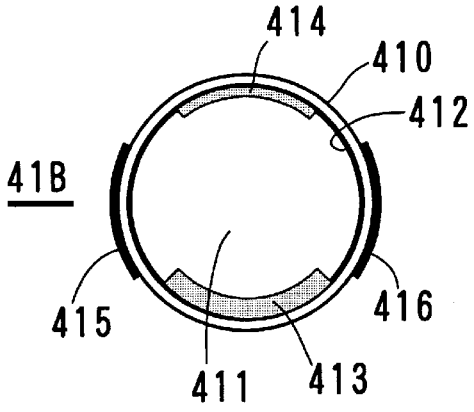
FIGS. 9A–9D are diagrams showing another example of the illuminator.
Figure 9B:
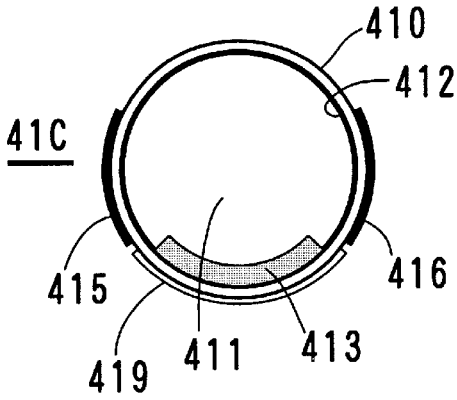
Figure 9C:
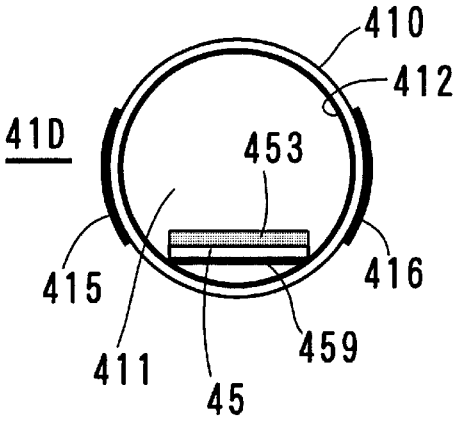

In the illuminator 41B show in FIG. 9A, a fluorescent material 414 that is thinner than the fluorescent material layer 413 is disposed at the front side and inside the glass tube 410. The light emission color of the fluorescent material 414 is the same as that of the fluorescent material layer 413. Since the fluorescent material 414 is thin, the visible light that was generated in the fluorescent material layer 413 passes the fluorescent material 414 without being significantly attenuated. The light emission of the fluorescent material 414 enhances the luminance. In the illuminator 41C shown in FIG. 9B, a reflection film 419 is provided at the rear portion of the fluorescent material layer 413 on the outer surface of the glass tube 410 so as to enhance the efficiency of light emission. The material of the reflection film 419 can be a metal film such as an aluminum film or a low melting point glass that is colored white. The reflection film can be provided on the substrate 21 (see, FIG. 4A–5C). In the illuminator 41D shown in FIG. 9C, the fluorescent material layer 453 is formed on the support member 45 that is separated from the glass tube 410. The fluorescent material layer 453 is disposed in the gas space 411 by inserting the support member 45 into the glass tube 410. The support member 45 is an elongated plate having the thickness of approximately 50 $\mu$m, and the backside thereof is provided with a reflection film 459. The reflection film 459 alternatively can be provided at the front side of the support member 45, and the fluorescent material layer 453 then can be formed on the reflection film 459. The fluorescent material layer 453 is formed by a screen printing method or an application method using a dispenser. In the structure using the separate support member 45, the fluorescent material layer 453 can be formed easily so as to exist in a part of the inner surface.

Figure 9D:
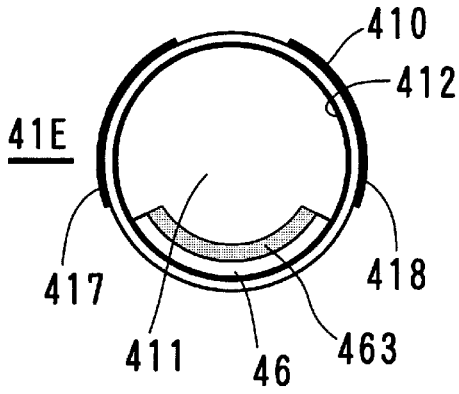

In the illuminator 41E shown in FIG. 9D, the fluorescent material layer 463 is formed on the plate support member 46 that is curved along the inner surface of the glass tube 410. The fluorescent material layer 463 is disposed in the gas space 411 by inserting the support member 46 into the glass tube 410. The support member 46 is made by cutting a glass tube having the outer diameter of 0.8 mm in the longitudinal direction, for example. In order to reduce a deterioration of the fluorescent material due to the discharge, the auxiliary conductors 417 and 418 are disposed on the exterior sidewall, generally at the front side of the table 410 and opposite to the fluorescent material layer 463 and are made of transparent conductive material so as to avoid creating a light shield.

In another structure, a fluorescent material layer that covers the entire inner surface of the glass tube 410 can be provided. The front side portion of the fluorescent material layer is preferably thinner than the backside portion so that the light emission efficiency is enhanced. The fluorescent material layer having parts of different thickness can be formed by the following process. A fluorescent material paste is injected inside the glass tube 410 after the protection film 412 is formed. Then the glass tube 410 is laid in the horizontal position while the fluorescent material paste is dried. Since the fluorescent material particles are settled by their weight during the drying process, the fluorescent material is formed in such a way that the lower portion is thick and the upper portion is thin at the inner wall of the tube. In another method, a photosensitive paste is used, and the exposing light quantity is adjusted so that the film thickness can be altered. By these methods, the thickness of the fluorescent material layer can be not uniform, and the auxiliary conductors 415, 416 are formed so that the thin portion is the front side.

Figure 10A:
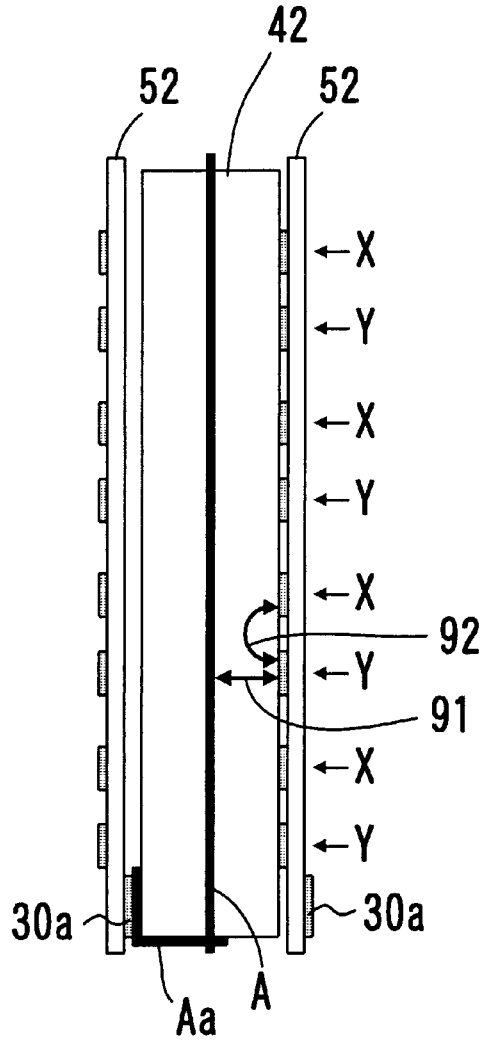
FIGS. 10A and 10B are diagrams showing a structure of the illuminator and the electrode supporter according to a second embodiment.
Figure 10B:
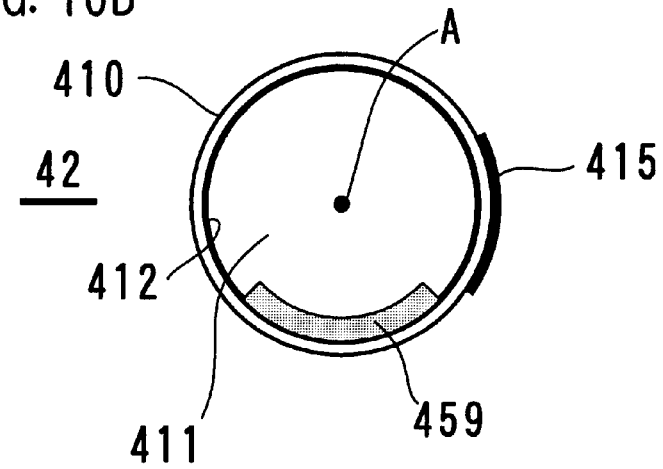

FIGS. 10A and 10B are diagrams showing a structure of the illuminator and the electrode supporter according to a second embodiment.

The illuminator 42 has an address electrode A that is a metal wire (made of copper or aluminum, for example) or a metal wire covered with an insulation coating along the axis of the glass tube 410. A conductor pattern Aa is provided at one end of the glass tube 410 for leading out the address electrode A to the outer surface of the glass tube 410, and a conductor pattern 30*a* contacting this conductor pattern Aa is provided at one side of the electrode supporter 52. Plural electrode pairs, each pair including an electrode X and an electrode Y, are arranged on the other side of the electrode supporter 52. An auxiliary conductor 415 is disposed at the outer surface of the illuminator 42 so as to contact with an electrode X and an electrode Y. In the illuminator 42, a discharge 91 is generated between the address electrode A and the electrode Y for selecting a cell, and a discharge 92 is generated between the electrode X and the electrode Y so that the fluorescent material layer 459 emits light in the same way as the three-electrode surface discharge type PDP.

Figure 11A:
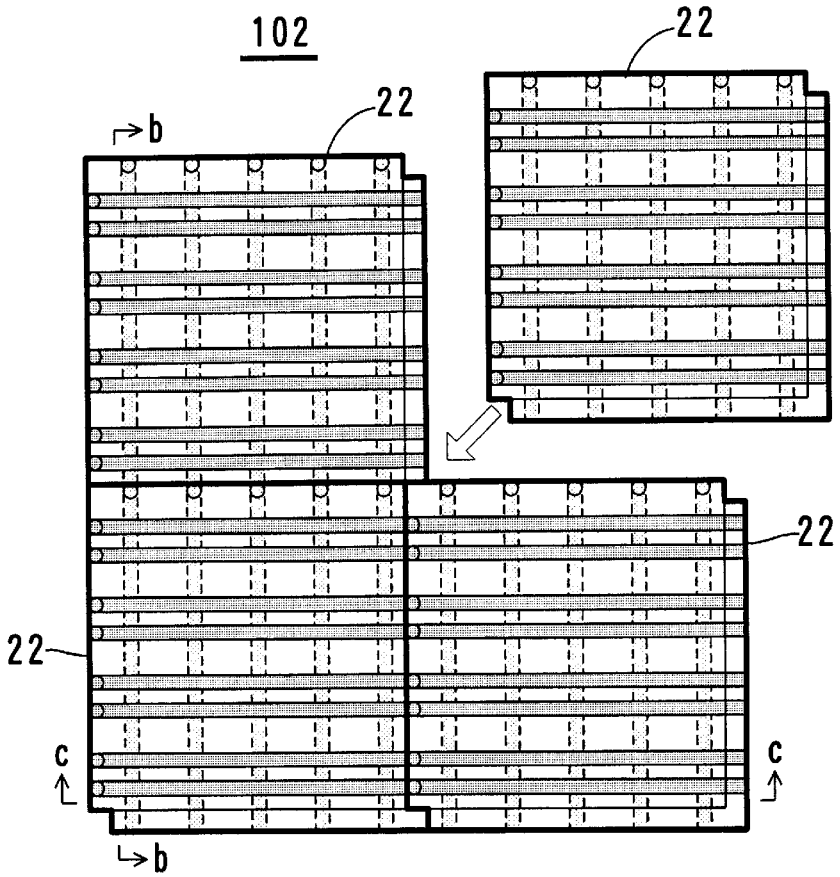
FIGS. 11A–11C are diagrams showing the substrate arrangement of the integrated display device according to the second embodiment.
Figure 11B:
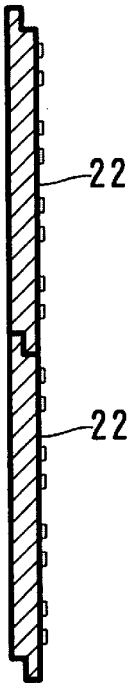
Figure 11C:
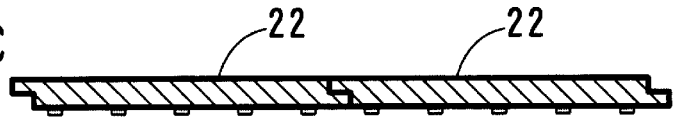

FIGS. 11A–11C are diagrams showing the substrate arrangement of the integrated display device according to the second embodiment.

The integrated display device 102 includes plural substrates 22 being linked in the horizontal direction and the vertical direction. Wiring conductive patterns that are connected with the electrodes X, Y are formed on one side of each substrate 22. On the other side, wiring conductive patterns for connecting the address electrode A between the substrates and a through hole for connecting them with the conductor pattern 30*a* of the electrode supporter 52 are formed. In addition, a step portion for a junction is provided on all sides of the substrate 22. The structure of the junction is the same as in FIG. 8.

Figure 12A:
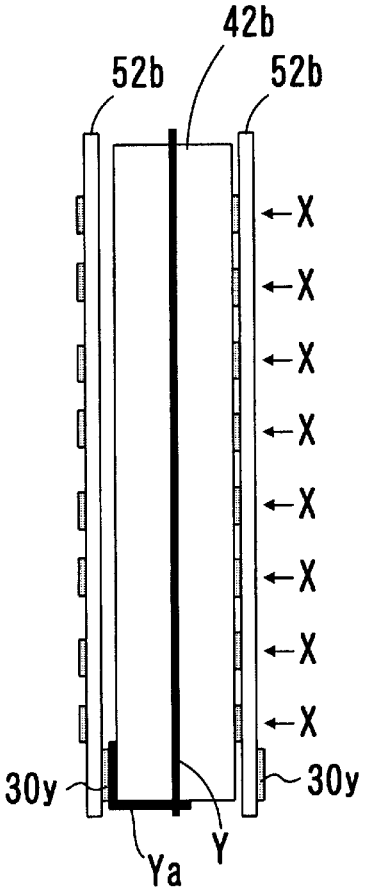
FIGS. 12A and 12B are diagrams showing a variation of the electrode supporter and the substrate according to the second embodiment.
Figure 12B:
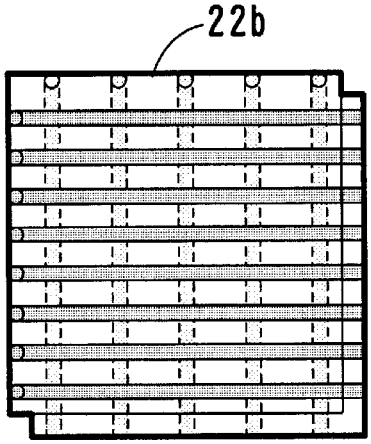

FIGS. 12A and 12B are diagrams showing a variation of the electrode supporter and the substrate according to the second embodiment. The structure of the illuminator 42*b* is the same as the illuminator 42 shown in FIG. 10. However, the metal wire braced inside is used as the electrode Y for the display discharge. The electrode Y is electrically connected to the conductor pattern 30*y* that is formed on one side of the electrode supporter 52*b* via the conductor pattern Ya that is formed on the outer surface of the glass tube. On the other surface of the electrode supporter 52*b*, plural electrodes X are arranged at the constant gap. In the illuminator 42*b*, the cell selection is formed in the simple matrix format. Conductor patterns are arranged on the substrate 22*b* that supports the plural illuminator 42*b* at a constant pitch corresponding to the arrangement of the electrodes X.

Figure 13:
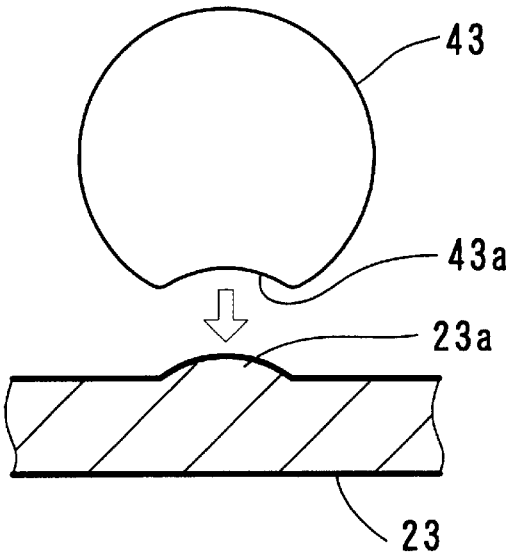
FIG. 13 is a diagram showing a variation of the outer shape of the illuminator.

FIG. 13 is a diagram showing a variation of the outer shape of the illuminator.

The illuminator 43 has a concave portion 43*a* at the rear side, and the substrate 23 has a convex portion 23*a* corresponding to the concave portion 43*a*. The engagement of the concave portion 43*a* with the convex portion 23*a* makes the registration of the illuminator 43 easy, and the illuminator 43 can be retained securely.

Figure 14A:
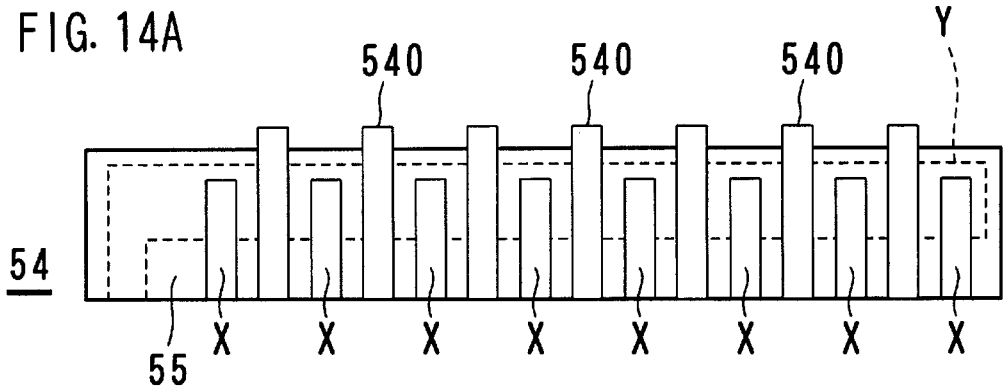
FIGS. 14A and 14B are diagrams showing another embodiment of assembling the display device.
Figure 14B:
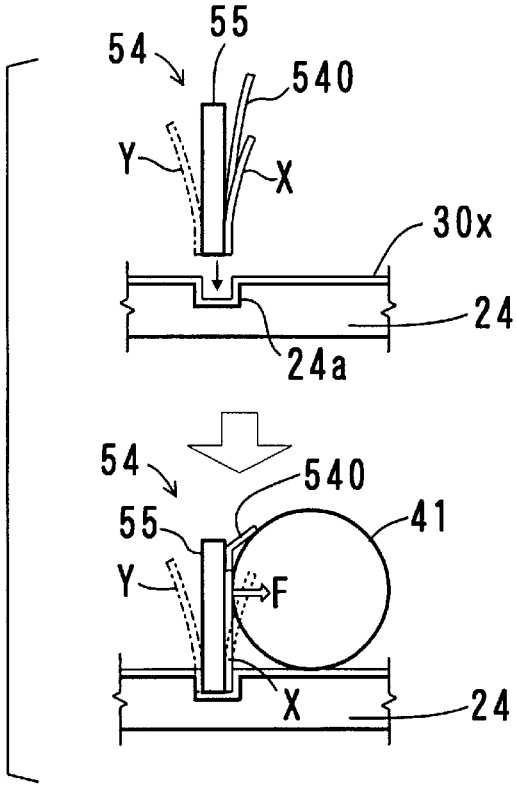

FIGS. 14A and 14B are diagrams showing another embodiment of assembling the display device.

The substrate 24 is provided with a groove 24*a* in which the siding portion of the electrode supporter 54 fits for fixing (i.e., securing) the electrode supporter 54. Plural strap electrodes X are provided on one side of the electrode supporter 54, and elongated electrodes Y are provided on the other side. Each electrode X has a lower end that is fixed to the support member 55 and an upper end bending away from the support member 55. The electrode supporter 54 fits in the groove 24*a* of the substrate 24 for fixing (i.e., securing) same thereto and the illuminator 41 is arranged on the substrate 24, when the electrode X is pushed toward the support member 55. Thus, the electrode X generates a force F that tries to push back the illuminator 41. As explained with reference to FIGS. 1A–1C, in the state where the illuminator 41 is sandwiched between a pair of electrode supporters 54, the force F works to fix the illuminator 41. As shown in FIG. 14A, a metal piece 540 that is longer than the electrode X is disposed between the electrodes X, so that the illuminator 41 can be pressed by bending the upper end of the metal piece 540 after arranging the illuminator 41 on the substrate 24. The metal piece 540 can be bent appropriately in advance. It is not necessary to supply electricity to the metal piece 540. The electrode Y can be also used as a pressing member in the same way as the electrode X.

Figure 15A:
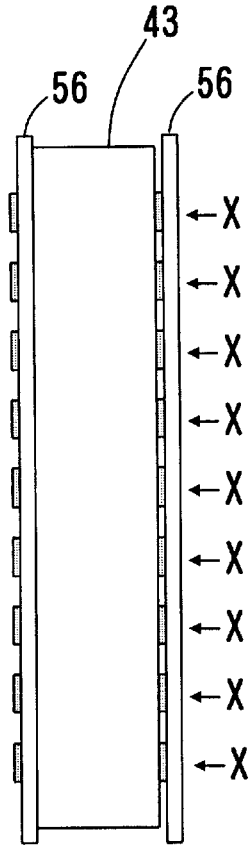
FIGS. 15A and 15B are diagrams showing a structure of the illuminator and the electrode supporter according to the third embodiment.
Figure 15B:
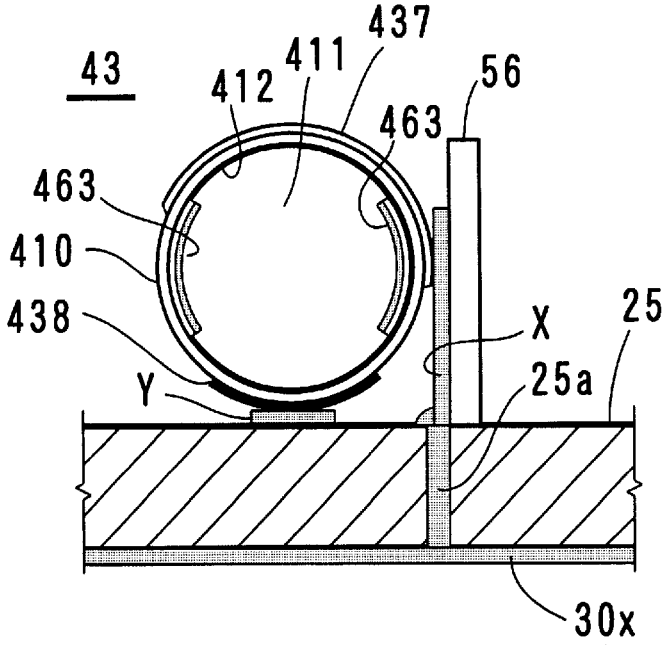

FIGS. 15A and 15B are diagrams showing a structure of the illuminator and the electrode supporter according to the third embodiment.

Plural electrodes X are arranged in a constant pitch on one side of the electrode supporter 56, and the other side is not provided with any electrode. The electrode Y that makes a pair with the electrode X is formed on the substrate 25. As shown in FIG. 15B, a conductor pattern 30*x* is formed on the back side of the substrate 25, and the electrode X is connected to the conductor pattern 30*x* via the through hole 25*a*. In this structure, the requirement of the insulation property of the electrode supporter 56 is not so strict as in the structure, e.g., of supporters 50 in FIGS. 1A and 1B, in which the electrodes are formed on both sides.

In the illuminator 43, the auxiliary conductor 437 that contacts the electrode X is a transparent conductive film covering the outer surface of the glass tube 410 from the side portion to the upper portion, and the auxiliary conductor 438 contacting the electrode Y is a metal film having a high reflectivity. A fluorescent material layer 463 is formed on the support member that is curved along the inner surface of the glass tube 410. The fluorescent material layer 463 is disposed at the left and the right sides in the gas space 411 by inserting a pair of fluorescent material support members into the glass tube 410.

In the above-mentioned embodiment, the substrates 21–25 can have a curved surface. In addition, the substrates 21–25 can be arranged along a curved surface, so that a curved screen can be assembled. The arrangement direction of the illuminators is not limited to the horizontal direction. The illuminator can be arranged in the vertical direction. However, it is advantageous to arrange the illuminators in the horizontal direction when assembling a normal screen that is longer in the horizontal direction. Since the illuminator can be the arrangement length, the display can be manufactured at lower cost.

In order to enhance the intensity of the illuminators 41, 41B–41E, 42 and 43, the outer surface of the glass tube 410 can be coated with an acrylic resin, a silicone resin or other transparent material. In addition, the glass tube 410 can be replaced with a tube made of a resin (e.g., a silicone resin) that is superior to a glass in the intensity and has a thermostability.

According to the present invention, a display device can be realized that has a group of elongated illuminators that enable the electrode matrix to be formed easily.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A display device having a screen including a substrate and a group of elongated illuminators arranged on the substrate, wherein an elongated electrode supporter, having plural electrodes aligned along a longitudinal direction or the illuminator, is arranged on at least one side of each illuminator in a width direction of the electrode supporter, wiring conductor patterns for supplying electricity to the plural electrodes are formed on the substrate, and a partial light emission of the illuminator is controlled by the wiring conductor patterns and the plural electrodes.

2. The display device according to claim 1, wherein plural conductors for defining the area of the partial light emission are fixed to the outer surface of the illuminator, so that each of the conductors contacts each of the plural electrodes.

3. The display device according to claim 1, wherein the plural electrodes of the electrode supporter are supported by an elastic insulator.

4. The display device according to claim 1, where the plural electrodes of the electrode supporter are supported by an insulator comprising a forcing element that presses against the illuminator.

5. The display device according to claim 1, wherein the electrode supporter has a plate-like shape, plural first electrodes are formed on one side of the electrode supporter, a second electrode is formed on the other side, and the electrode supporter disposed between the neighboring illuminators is used for controlling the illuminators.

6. The display device according to claim 5, wherein the plural first electrodes are anodes and the second electrode is a cathode

7. An integrated display device comprising plural display devices side by side having the same structure as the display device according to claim 1.

8. The display device according to claim 1, wherein the illuminator has a tube-like body containing a discharge gas and a fluorescent material layer that emits light by a gas discharge.

9. The display device according to claim 8, wherein the illuminator has a first fluorescent material layer that is arranged on the rear side of the discharge gas space and a second fluorescent material layer that is arranged on the front side of the discharge gas space and is thinner than the first fluorescent material layer.

10. The display device according to claim 8, wherein the fluorescent material layer of the illuminator is disposed in the tube that encloses the discharge gas space after forming a protection film on the inner surface of the tube.

11. The display device according to claim 8, wherein the fluorescent material layer of the illuminator is formed on a supporting member that is separated from the tube, and the fluorescent material layer is disposed in the tube by inserting the supporting member inside the tube.

12. The display device according to claim 11, wherein a reflection layer is formed on the supporting member.

13. The display device according to claim 8, wherein a conductor is arranged that extends over the entire length in the longitudinal direction inside the discharge gas space of the illuminator.

14. The display device according to claim 1, wherein the substrate has a protrusion for registration of the illuminator, and the illuminator has a recess that engages the protrusion.

15. The display device according to claim 1, wherein the illuminator has a tube-like body containing a discharge gas and a fluorescent material layer that emits light by a gas discharge, plural conductors for defining the area of the partial light emission are fixed to the outer surface of the illuminator so that each of the conductors contacts each of the plural electrodes, the plural conductors are arranged on one side in the front and rear direction, and the fluorescent material layer is arranged on the opposite side to the conductor.

16. A display device having a screen including a substrate and plural elongated illuminators arranged in parallel in a longitudinal direction on the substrate, comprising:

an elongated electrode supporter having plural first electrodes supported thereon, spaced along the longitudinal direction of the illuminator and defining corresponding, plural longitudinally spaced display cells in each illuminator, arranged on at least one side of each illuminator in a width direction of the electrode supporter;

wiring conductor patterns, for supplying electricity to the plural first electrodes, formed on the substrate; and selective light emission by the plural display cells of the illuminator being controlled by signals conducted by the wiring conductor patterns and the plural electrodes.

17. The display device according to claim 16, further comprising:

plural conductors defining respective areas of the display cells fixed to an outer surface of the illuminator, so that each of the plural conductors contacts a respective, first electrode of the plural first electrodes.

18. The display device according to claim 16, wherein the plural electrodes of the electrode supporter are supported by an elastic insulator.

19. The display device according to claim 16, wherein the plural first electrodes of the electrode supporter are supported by an insulator and forcibly engage the illuminator.

20. The display device according to claim 16, wherein each electrode supporter has a plate-like shape, the plural first electrodes are formed on one side of the electrode supporter, and further comprising a second electrode formed on the other side of the electrode supporter, the electrode supporter being disposed between neighboring illuminators and used for controlling the neighboring illuminators.

21. The display device according to claim 20, wherein the first and second electrodes are anodes and cathodes, respectively.

22. An integrated display device comprising plural display devices side by side having the same structure as the display device according to claim 16.

23. The display device according to claim 16, wherein the illuminator has a tube-like body containing a discharge gas and a fluorescent material layer that emits light by a gas discharge.

24. The display device according to claim 23, wherein the illuminator has a first fluorescent material layer that is arranged on a rear side of the discharge gas space and a second fluorescent material layer that is arranged on a front side of the discharge gas space and is thinner than the first fluorescent material layer.

25. The display device according to claim 23, wherein the fluorescent material layer of the illuminator is disposed in the tube-like body after forming a protection film on an inner surface of the tube-like body.

26. The display device according to claim 23, wherein the fluorescent material layer of the illuminator is formed on a supporting member that is separated from the tube-like body, and the fluorescent material layer is disposed in the tube-like body by inserting the supporting member inside the tube.

27. The display device according to claim 26, wherein a reflection layer is formed on the supporting member.

28. The display device according to claim 23, further comprising a conductor extending along the entire length of, and in the longitudinal direction inside, the discharge gas space of the illuminator.

29. The display device according to claim 16, wherein the substrate has a protrusion for registration of the illuminator, and the illuminator has a recess that engages the protrusion.

30. The display device according to claim 16, wherein the illuminator has a tube-like body containing a discharge gas, further comprising:

a fluorescent material layer that emits light by gas discharge;

plural conductors, corresponding to respective areas of the display cells, fixed to an outer surface of the illuminator so that each of the conductors contacts a respective electrode of the plural first electrodes, the plural conductors being arranged on one of the front and rear sides of the tube-like body, and the fluorescent material layer is arranged on the opposite one of the front and rear sides of the tube-like body, relatively to the plural conductors.

31. An elongated tubular illuminator, comprising:

a tube having a contoured interior surface;

a discharge gas filled in the tube; and a fluorescent material layer, emitting light when subjected to electrical discharge of the discharge gas, formed on a supporting member that is movable relatively to the tube thereby to insert the supporting member into the tube and position the fluorescent material layer within the tube.

32. The illuminator according to claim 31, wherein the inserted supporting member is positioned on a rear side of the interior surface of the tube.

33. The illuminator according to claim 32, wherein the supporting member is an elongated plate having a contoured cross-section mating the contoured interior surface of the tube, the plate being positioned coaxially within, and on the interior surface of, the tube.

34. The illuminator according to claim 33, wherein a reflection film is formed on the rear of the supporting member and the fluorescent material layer is formed on the front surface of the supporting member.

35. The illuminator according to claim 32, wherein the supporting member is an elongated flat plate.

36. The illuminator according to claim 35, wherein a reflection film is formed on the rear of the supporting member and the fluorescent material layer is formed on the front surface of the supporting member.

37. The illuminator according to claim 31, further comprising a protection film coating the interior surface of the tube.

38. The illuminator according to claim 37, wherein the supporting member is positioned on, and surrounded by, the protection film.

39. The illuminator according to claim 37, wherein the protection film is made of magnesia.

40. The illuminator according to claim 31, wherein the tube is a glass tube.

41. The illuminator according to claim 40, wherein the supporting member is a glass plate.

42. The illuminator according to claim 31, wherein tho tube is made of silicon resin.

43. The illuminator according to claim 31, wherein the tube has a cylindrical configuration.

44. A display device having a screen, a substrate and a group of elongated illuminators arranged on the substrate, comprising:

a plurality of electrodes fixed to the substrate and contacting outer surfaces of the illuminators, the electrodes controlling light omission from each of the illuminators; and each of the illuminators comprising:

a tube having a contoured interior surface, a discharge gas filled in the tube, and a fluorescent material layer, emitting light when subjected to electrical discharge of the discharge gas, formed on a supporting member that is movable relatively to the tube thereby to insert the supporting member into the tube and position the fluorescent material layer within the tube.

45. The display device according to claim 44, further comprising:

plural conductors, defining cells, affixed to respective outer surfaces of the tubes in the illuminators, each of the plural conductors contacting a corresponding one of the electrodes.

* * * * *

UNITED STATES PATENT AND TRADEMARK OFFICE

CERTIFICATE OF CORRECTION

PATENT NO. : 6,577,060 B2
DATED : June 10, 2003
INVENTOR(S) : Akira Tokai et al.

It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 5,353,133 | 10/1994 | Bernkopf |
| 5,274,243 | 12/1993 | Hochgraf |
| 4,990,804 | 02/1991 | McNair -- |

Signed and Sealed this

Twenty-third Day of December, 2003

JAMES E. ROGAN
*Director of the United States Patent and Trademark Office*